US005756442A

United States Patent [19]

Jeschke et al.

[11] Patent Number: 5,756,442

[45] Date of Patent: May 26, 1998

[54] POURABLE LIQUID, AQUEOUS CLEANING CONCENTRATES II

[75] Inventors: Rainer Jeschke; Eva Kiewert; Katica Bocarac; Rainer Hofmann, all of Duesseldorf, Germany

[73] Assignee: Henkel Kommanditgesellschaft auf Aktien, Duesseldorf, Germany

[21] Appl. No.: 556,977

[22] PCT Filed: Jun. 3, 1994

[86] PCT No.: PCT/EP94/01816

§ 371 Date: Dec. 11, 1995

§ 102(e) Date: Dec. 11, 1995

[87] PCT Pub. No.: WO94/29418

PCT Pub. Date: Dec. 22, 1994

[30] Foreign Application Priority Data

Jun. 11, 1993 [DE] Germany ..... 43 19 287.4

[51] Int. Cl.[6] ..... C11D 3/32; C11D 3/48

[52] U.S. Cl. ..... 510/236; 510/235; 510/421; 510/422; 510/425

[58] Field of Search ..... 510/235, 236, 510/421, 422, 425

[56] References Cited

U.S. PATENT DOCUMENTS

| | | | |
|---|---|---|---|
| 4,179,414 | 12/1979 | Clayton | 252/548 |
| 4,302,347 | 11/1981 | Straw et al. | 252/116 |
| 4,396,525 | 8/1983 | Rubin et al. | 252/174.25 |
| 4,569,782 | 2/1986 | Disch et al. | 252/106 |
| 4,820,436 | 4/1989 | Andree et al. | 252/544 |
| 4,976,885 | 12/1990 | Wisotzki et al. | 252/174.17 |
| 5,034,159 | 7/1991 | Tesmann et al. | 252/551 |
| 5,484,548 | 1/1996 | Kiewert et al. | 252/174.16 |
| 5,507,971 | 4/1996 | Ouzounis et al. | 252/124.24 |

FOREIGN PATENT DOCUMENTS

| | | |
|---|---|---|
| 0193375 | 9/1986 | European Pat. Off. . |
| 0334566 | 9/1989 | European Pat. Off. . |
| 0592947 | 4/1994 | European Pat. Off. . |
| 3817415 | 11/1989 | Germany . |
| 4227863 | 2/1994 | Germany . |
| WO9108282 | 6/1991 | WIPO . |

OTHER PUBLICATIONS

Seifen–Oele–Fette–Wachse, 116, 60–68 (1990).
Seifen–Oele–Fette–Wachse, 112, 371 (1986).

*Primary Examiner*—Paul Lieberman
*Assistant Examiner*—Necholus Ogden
*Attorney, Agent, or Firm*—Ernest G. Szoke; Wayne C. Jaeschke; Henry E. Millson, Jr.

[57] ABSTRACT

Pourable, liquid, aqueous cleaning concentrates comprising a) at least about 10% by weight of at least one water soluble abrasive; and b) from about 2 to about 30% by weight of a mixture of narrow-range alkyl polyglycol ethers, amphoteric surfactants and soap, the ratio by weight of amphoteric surfactants to narrow-range alkyl polyglycol ethers being 1:10 to 3:1, the ratio by weight of amphoteric surfactants to soap being 15:1 to 1:3 and the ratio by weight of narrow-range alkyl polyglycol ethers to soap being 25:1 and 1:1.

16 Claims, No Drawings

POURABLE LIQUID, AQUEOUS CLEANING CONCENTRATES II

BACKGROUND OF THE INVENTION

1. Field of the Invention

This invention relates to pourable, liquid, aqueous cleaning concentrates which may be used in undiluted form as scouring compositions and in diluted form as all-purpose cleaners. Concentrates of the type in question are known and are based on the co-use of water-soluble abrasive components which perform a scouring function in concentrated media, but which virtually dissolve in dilute media and, after application, can readily be removed from the substrate simply by rinsing with water.

2. Statement of Related Art

U.S. Pat. No. 4,179,414 describes stable pastes which consist of around 50 to 65% by weight of sodium bicarbonate, around 50 to 35% by weight of water and around 5 to 20% by weight of sodium chloride and also of around 10 to 30% by weight of $C_{12-16}$ fatty acid diethanolamide, both based on the percentage water content, and which have a scouring effect in concentrated form and which clean hard surfaces in dilute form. No figures are provided as to the particle size of the sodium bicarbonate. EP 0 193 375 A2 describes liquid compositions which may contain 1.5 to 30% by weight of surfactants and 6 to 45% by weight of sodium bicarbonate with an average diameter of 10 to 500 μm. The rest consists of water. EP 0 334 566 A2 describes aqueous compositions containing 1.5 to 40% by weight of surfactants, 2.0 to 65% by weight of predominantly undissolved potassium sulfate with the same particle size as mentioned above, preferably 20 to 300 μm, and optionally 0.5 to 10% by weight of sodium chloride. International patent application WO 91/08282 describes liquid scouring cleaners containing water-soluble abrasives in which around 1.5 to 30% by weight of surfactants, around 45 to around 75% by weight of sodium bicarbonate with a small average particle size of—specifically— less than 80 μm and more than 10% by weight of water may be present. Finally, DE 42 27 863.5 describes liquid cleaning concentrates containing water-soluble abrasives of which around 2 to 30% by weight consists of a low-foaming surfactant mixture and around 50 to 65% by weight of sodium bicarbonate with an average particle size of around 200 μm.

Almost all known pourable, liquid, aqueous cleaners containing water-soluble abrasive components contain a carrier phase consisting of a combination of anionic surfactants of the sulfonate and/or sulfate type and nonionic surfactants.

DESCRIPTION OF THE INVENTION

The problem addressed by the present invention was to provide a modern, abrasive-containing liquid cleaning composition which would meet the following requirements:

good pourability for easy and exact dosing a good abrasive cleaning effect against obstinate soil problem-free removal, particularly of the abrasive, by rinsing low foaming during rinsing and when used in diluted form high ecological standard use of dermatologically mild surfactants.

A low-foaming carrier phase made up of surfactants particularly mild to the skin has surprisingly been found, enabling both coarse sodium bicarbonate with an average particle size of around 200±100 μm, which is distinguished by a particularly good abrasive cleaning effect, and also relatively fine sodium bicarbonate with an average particle size distribution of around 65±40 μm, which is distinguished by a particularly creamy soft consistency, to be dispersed in stable form. This carrier phase consists essentially of narrow-range alkyl polyglycol ethers, amphoteric surfactants and soaps.

Accordingly, the present invention relates to pourable, liquid, aqueous cleaning concentrates containing surfactants and a water-soluble abrasive which may be used in concentrated form as scouring compositions and in dilute form as all-purpose cleaners, characterized in that they contain a) as water-soluble abrasive at least about 10% by weight and preferably around 20 to 60% by weight of sodium bicarbonate with an average particle size of around 20 to 500 μm and preferably of around 50 to 300 μm and b) around 2 to 30% by weight and preferably around 3 to 20% by weight of a low-foaming surfactant mixture of narrow-range alkyl polyglycol ethers, amphoteric surfactants and soap, the ratio by weight of amphoteric surfactants to narrow-range alkyl polyglycol ethers being 1:10 to 3:1, the ratio by weight of amphoteric surfactants to soap being 15:1 to 1:3 and the ratio by weight of narrow-range alkyl polyglycol ethers to soap being 25:1 to 1:1.

Anionic surfactants of the sulfate or sulfonate type may optionally be present, although the cleaning concentrates according to the invention are preferably free from anionic surfactants of the sulfate or sulfonate type.

The water-soluble abrasives may be selected from a large number of inorganic salts, for example sodium sulfate, sodium carbonate, sodium chloride, although sodium bicarbonate (hereinafter referred to in short as bicarbonate) above all meets the requirements laid down for a commercially practicable product (cf. WO 91/8282, pages 12 et seq.).

Suitable alkyl polyglycol ethers are those with a narrow homolog distribution of the added ethylene oxide, as known from A. Behler et al., Seifen-Öle-Fette-Wachse, 116, 60–68 (1990), and from DE 38 17 415, which have a thickening effect and which are also distinguished by the fact that they are particularly mild to the skin and are readily biodegradable. Alkyl polyglycol ethers of this type include, for example, the narrow-range alkyl polyglycol ethers containing around 8 to 18 and preferably around 9 to 16 carbon atoms in the alkyl radical and around 2 to 8 and preferably around 2 to 5 ethylene oxide units (EO) in the molecule. They are present in the cleaning concentrates according to the invention in a quantity of 1 to 20% by weight and preferably 2 to 15% by weight. By "narrow-range alkyl polyglycol ethers" is meant that in a reaction between an alcohol and n moles of ethylene oxide to give on average an ethoxylate-$(EO)_n$, between 80 and 90% of the product is in the range of ethoxylate-$(EO)_{n-2}$ to ethoxylate-$(EO)_{n+2}$.

Mildness to the skin also applies to the amphoteric surfactants which include around 0.5 to 10% by weight and preferably around 1 to 5% by weight of quaternary ammonium compounds consisting of an alkyl radical containing around 7 to 18 carbon atoms and a hydrophilic head group. N-(3-N'-$C_{8-18}$-acylaminopropyl)-N,N-dimethylammonium acetate and N-alkyl-N,N-dimethylammonium acetate are preferably used.

Nowadays, minimal foaming is essential for the acceptance of modern domestic cleaning products. Since the combination of the nonionic surfactants and amphoteric surfactants foams intensively, foam regulators have to be added. Soaps in quantities of around 0.05 to 5% by weight and preferably in quantities of around 0.5 to 3% by weight have proved to be particularly effective in this regard, examples including linear or branched, saturated or unsaturated carboxylic acids containing around 7 to 22 carbon atoms and preferably around 10 to 22 carbon atoms in the alkyl group and/or alkali metal, ammonium and/or alkylammonium salts thereof. The alkali metal salts, preferably sodium salts, and the magnesium salts of coconut oil fatty acid, isostearic acid and mixtures thereof are particularly effective.

The individual classes of surfactants in the surfactant mixture may be represented by one or more of their compounds. As usual in oleochemistry, the alkyl polyglycol ethers may be derived from technical alcohol mixtures of the type obtained, for example, by high-pressure hydrogenation of methyl esters based on vegetable or animal raw materials or by hydrogenation of aldehydes from ROELEN's oxosynthesis.

In addition to the surfactants mentioned under b), typical $C_{8-18}$ alkyl polyglycol ethers with a normal distribution of the ethylene oxide units, for example the products commercially available as Dehydol, may be present in a quantity of 1 to 20% by weight. In addition, $C_{8-18}$ fatty acid mono- and dialkanolamides, for example the $C_{8-18}$ fatty acid monoethanolamide commercially available as Comperlan 100, may optionally be present in a quantity of 0.1 to 4% by weight.

The flow properties and stability of the dispersion may be positively influenced by addition of up to 5% by weight and preferably 0.5 to 3% by weight of a polyalkylene glycol corresponding to the general formula $H\text{-}(OC(H)R^1\text{-}CH_2)_n\text{-}OH$, where $R^1$ is hydrogen or a methyl group and n is an integer of 4 to 40, and/or by addition of up to 5% by weight and preferably 0.2 to 3% by weight of alkyl polyglycosides corresponding to the general formula $R^2O\text{-}(Z)_x$, where $R^2$ is a linear or branched alkyl or alkenyl group containing 6 to 22 carbon atoms, Z is a sugar unit from the group of aldopentoses or aldohexoses, for example glucose, mannose and xylose, and x is on average a number of 1.3 to 1.8.

Suitable polyalkylene glycols are, for example, the polyethylene glycols with average molecular weights of 600 and 1000 marketed under the names of Polydiol 600 and Polydiol 1000. Suitable alkyl polyglycosides are, for example, $C_{8-10}$ alkyl polyglucosides which are marketed under the name of Plantaren 225.

In addition, preferred cleaning concentrates contain an inorganic material which stabilizes the carrier phase in a quantity of 0.2 to 5% by weight and preferably in a quantity of 0.5 to 3% by weight. Stabilizing inorganic materials in the context of the invention are understood to be substances which contribute towards the stabilization and viscosity regulation of the cleaning concentrates according to the invention. The inorganic material is preferably selected from the group of layer silicates, aluminium oxide hydrates and precipitated silicas. Suitable layer silicates are, for example, montmorillonite, calcium silicate and magnesium silicate.

The inorganic materials surprisingly have no adverse effect on the desired properties of the cleaning concentrates, for example ready removability by rinsing, after use in concentrated form.

Particularly preferred cleaning concentrates contain 0.1 to 3% by weight and preferably 0.2 to 2% by weight of polymers selected from the group of polysaccharides, modified cellulose molecules and synthetic polycarboxylates. Suitable polysaccharides are, for example, xanthan gum or carob bean flour. Modified cellulose molecules are understood to be cellulose substituted by such groups as, for example, carboxymethyl, hydroxyethyl, hydroxypropyl or methyl. Suitable synthetic polycarboxylates are homopolymers or copolymers of acrylic acid, methacrylic acid, maleic acid or alkali metal salts thereof and $C_{1-4}$ alkyl esters optionally crosslinked by such compounds as, for example, diallyl sucrose. The molecular weights of the polycarboxylates are preferably above 100,000.

In addition, the concentrates according to the invention may contain typical constituents, such as inorganic or organic builders, for example in the form of low molecular weight dicarboxylic acids or sodium chloride, known solubilizers, such as hydrotropes and solvents, preservatives, other antimicrobial agents, dyes and fragrances.

Sodium bicarbonate forms a buffer at pH 8.7 so that the pH value of the concentrates according to the invention is generally between 8.0 and 9.0.

The cleaning compositions according to the invention are produced by mixing the individual constituents in the following order while stirring with a commercially available blade stirrer: approximately 6% of the total quantity of bicarbonate is dissolved in water at around 40° C., the fatty acid being added to the resulting solution in molten form. After the formation of a homogeneous mixture, the mixture is cooled to 25° C. and the remaining constituents are subsequently added.

EXAMPLES

To demonstrate the advantages of the cleaning compositions according to the invention, tests were carried out by the following methods:

A Brookfield RVT viscosimeter, spindle 4, 20 revolutions per minute, was used to measure viscosity in m.Pas. The measurements were conducted at 20° C.

Cleaning power was tested by the method described below which provides readily reproducible results. The removal of soil from hard surfaces was evaluated by the cleaning performance test described in Seifen-Öle-Fette-Wachse 112, 371 (1986).

The cleaning composition to be tested was applied to artificially soiled plastic surfaces. A mixture of soot, machine oil, triglyceride of saturated fatty acids and low-boiling aliphatic hydrocarbon was used as the artificial soil for dilute application of the cleaning composition. The 26×28 cm test area was uniformly coated with 2 g of the artificial soil using a surface spreader.

A synthetic sponge was impregnated with 10 ml of the cleaning solution to be tested and moved mechanically over the test surface which had also been coated with 10 ml of the cleaning solution to be tested. After 10 wiping movements with the synthetic sponge, the cleaned test surface was held under running water and the loose soil was removed. The cleaning effect, i.e. the whiteness of the plastic surface thus cleaned, was measured with a Dr. Lange Microcolor color difference measuring instrument. The clean white plastic surface was used as the white standard. Since the Microcolor instrument was adjusted to 100% for measurement of the clean surface and since the soiled surface produced a reading of zero, the values read off for the cleaned plastic surfaces may be equated with the percentage cleaning performance (% CP). In the following tests, the CP rel. (%) values shown are the values determined by this method for the cleaning performance of the cleaners tested, based on the cleaning performance of the cleaner used as standard (CP=100%). They represent average values of three measurements.

The foaming behavior of the concentrates according to the invention was tested as follows:

The test product was placed in a wide-necked glass beaker. Tap water was then run freely into the glass beaker from a height of 30 cm in the quantity designed to produce the recommended in-use solution of the product with the quantity of product initially introduced.

The height of foam in the glass beaker was read off immediately after addition of the water and also 3 minutes thereafter. The foam height after 3 minutes was related to the initial foam and the foam collapse was calculated as follows:

$$\text{Foam collapse (\%)} = \frac{\text{Initial foam height} - \text{Foam height after 3 mins.}}{\text{Initial foam height}} \cdot 100$$

A cleaner with a foam collapse of more than 50% is defined as a low-foaming cleaner.

The quantities in the following Examples represent percentages by weight.

Examples 1 to 4

The Examples listed in Table 1 are intended to show typical ranges in which stable dispersions are obtained with the surfactant combinations according to the invention.

Examples 5 to 8

The Examples listed in Table 2 are intended to show that a large number of inorganic structures are suitable for improving the rheological behavior of the dispersions.

Examples 9 to 12

The Examples listed in Table 3 are intended to show that the carrier phase is capable of stabilizing various quantities of sodium bicarbonate and sodium bicarbonates varying in their particle size distributions.

Examples 13 to 16

The Examples listed in Table 4 are intended to show that polymers selected from the group of polysaccharides, modified cellulose molecules and synthetic polycarboxylates are suitable for improving the rheological behavior of the dispersions.

In the following Tables,

FA=Fatty alcohol (the alkyl radicals concealed behind this need not necessarily emanate from natural sources)

*CTFA name for the amphoteric surfactants mTg=Average particle size distribution NRE=Narrow range ethoxylates (ethoxylates with a narrow homolog distribution)

FSMAA=Fatty acid monoalkanolamide

MW=Molecular weight

TABLE 1

| Ingredients/Examples | 1 | 2 | 3 | 4 |
|---|---|---|---|---|
| $C_{12/14}$-FA-2.5 EO, NRE | 2.5 | 3.5 | 3.5 | 4 |
| $C_{12/14}$-FA-4 EO | 8 | 5 | 5 | 4 |
| $C_{10}$-FA-3 EO | — | 0.5 | 0.5 | 2 |
| $C_{12/18}$-FSMAA | — | 0.5 | — | — |
| Coco Betaine* | — | — | 3 | — |
| Cocoamidopropyl Betaine* | 2.5 | 3 | — | 3 |
| Cocofatty acid | 1 | 1 | 1 | 1 |
| Polyethylene glycol, MW 600 (Polydiol 600) | — | 1 | 0.8 | — |
| Polyethylene glycol, MW 1000 (Polydiol 1000) | 1 | — | — | — |
| $C_{8/10}$ Alkyl polyglucoside, x = 1.6 | — | — | — | 0.5 |
| Sodium bicarbonate, 100 μm mTg | 35 | 35 | 35 | 35 |
| Perfume | 0.4 | 0.4 | 0.4 | 0.4 |
| Deionized water | ad 100 | ad 100 | ad 100 | ad 100 |

TABLE 1-continued

| Ingredients/Examples | 1 | 2 | 3 | 4 |
|---|---|---|---|---|
| viscosity (mPas) | 5200 | 5800 | 4400 | 5300 |
| Foam collapse (%) | 100 | 100 | 96 | 93 |

TABLE 2

| Ingredients/Examples | 5 | 6 | 7 | 8 |
|---|---|---|---|---|
| $C_{12/14}$-FA-2.5 EO, NRE | 3.5 | 3.5 | 3.5 | 3.5 |
| $C_{12/14}$-FA-4 EO | 5 | 5 | 5 | 5 |
| $C_{12/14}$-FA-6 EO | 1 | 1 | 1 | 1 |
| Cocoamidopropyl Betaine* | 3 | 3 | 3 | 3 |
| Cocofatty acid | 1 | 1 | 1 | 1 |
| Polyethylene glycol, MW 600 (Polydiol 600) | 0.5 | 0.5 | 0.5 | 0.5 |
| Sodium bicarbonate, 200 μm mTg | 35 | 35 | 35 | 35 |
| Mg Silicate, synthetic | 0.8 | — | — | — |
| Montmorillonite, natural | — | 0.8 | — | — |
| Aluminium oxide hydrate | — | — | 0.8 | — |
| Silica | — | — | — | 0.8 |
| Perfume | 0.25 | 0.25 | 0.25 | 0.25 |
| Deionized water | ad 100 | ad 100 | ad 100 | ad 100 |
| Viscosity (mPas) | 4400 | 3650 | 3900 | 6250 |
| Foam collapse (%) | 88 | 96 | 100 | 96 |

TABLE 3

| Ingredients/Examples | 9 | 10 | 11 | 12 |
|---|---|---|---|---|
| $C_{12/14}$-FA-2.5 EO, NRE | 4.6 | 4.0 | 2.7 | 4.0 |
| $C_{12/14}$-FA-4 EO | 6.6 | 5.8 | 3.8 | 5.8 |
| $C_{12/14}$-FA-6 EO | 1.3 | 1.15 | 0.75 | 1.5 |
| Cocoamidopropyl Betaine* | 3.9 | 3.5 | 2.3 | 3.5 |
| Cocofatty acid | 1.3 | 1.15 | 0.75 | 1.15 |
| Polyethylene glycol, MW 600 (Polydiol 600) | 0.65 | 0.6 | 0.4 | 0.6 |
| Sodium bicarbonate, 200 μm mTg | 15 | 25 | 50 | — |
| Sodium bicarbonate, 65 μm mTg | — | — | — | 25 |
| Mg Silicate, synthetic | 0.8 | 0.8 | 0.8 | 0.8 |
| Perfume | 0.25 | 0.25 | 0.25 | 0.25 |
| Deionized water | ad 100 | ad 100 | ad 100 | ad 100 |
| Viscosity (mPas) | 2900 | 2900 | 6900 | 3400 |
| Foam collapse (%) | 93 | 93 | 72 | 96 |

TABLE 4

| Ingredients/Examples | 13 | 14 | 15 | 16 |
|---|---|---|---|---|
| $C_{12/14}$-FA-2.5 EO, NRE | 4 | 4 | 4 | 4 |
| $C_{12/14}$-FA-4 EO | 6 | 6 | 6 | 6 |
| Cocoamidopropyl Betaine* | 2.5 | 2.5 | 2.5 | 2.5 |
| Cocofatty acid | 1 | 1 | 1 | 1 |
| Polyethylene glycol, MW 600 (Polydiol 600) | 0.8 | 0.8 | 0.8 | 0.8 |
| Methyl hydroxypropyl celluose (Culminal MHPC 6000 PR) | 1 | — | — | — |
| Hydroxyethyl cellulose (Tylose H 100.000 YP) | — | 0.3 | — | — |
| Xanthan Gum (Rhodopol 50 MD) | — | — | 0.8 | — |
| Methyl methacrylate/ butyl acrylate copolymer (Acusol 830) | — | 0.25 | 0.25 | 0.25 |
| Sodium bicarbonate, 100 | 35 | 35 | 35 | 35 |

TABLE 4-continued

| Ingredients/Examples | 13 | 14 | 15 | 16 |
|---|---|---|---|---|
| μm mTG | | | | |
| Perfume | 0.4 | 0.4 | 0.4 | 0.4 |
| Deionized water | ad 100 | ad 100 | ad 100 | ad 100 |
| Viscosity (mPas) | 4100 | 6400 | 6300 | 5200 |
| Foam collapse (%) | 100 | 100 | 100 | 96 |

We claim:

1. A pourable, liquid, aqueous cleaning concentrate comprising a) from about 20% to about 60% by weight of sodium bicarbonate having an average particle size of from about 20 to about 500 μm as a water soluble abrasive; and b) from about 2 to about 30% by weight of a surfactant mixture of i) at least one alkyl polyglycol ether having a narrow homolog distribution of alkylene oxide, wherein 80%–90% is in a range of ethoxylate-(EO)n–2 to ethoxylate (EO)n+2, when n=2 to 8 alkylene oxide groups, ii) at least one amphoteric surfactant, and iii) at least one soap, wherein the ratio by weight of component ii) to component i) is from about 1:10 to about 3:1, the ratio by weight of component ii) to component iii) is from about 15:1 to about 1:3, and the ratio by weight of component i) to component iii) is from about 25:1 to about 1:1.

2. The cleaning concentrate of claim 1 wherein from about 20 to about 60% by weight of component a) is present in the concentrate.

3. The concentrate of claim 1 wherein said average particle size in component (a) is from about 50 to about 300 μm.

4. The concentrate of claim 1 wherein component b) i) contains from 8 to 18 carbon atoms in the alkyl group and from 2 to 8 alkylene oxide groups.

5. The concentrate of claim 4 wherein said alkylene oxide groups are ethylene oxide groups.

6. The concentrate of claim 4 wherein component b) i) contains from 9 to 16 carbon atoms in the alkyl group and from 2 to 5 alkylene oxide groups.

7. The concentrate of claim 6 wherein said alkylene oxide groups are ethylene oxide groups.

8. The concentrate of claim 1 wherein component b) is present in from about 2 to about 20% by weight.

9. The concentrate of claim 1 wherein component b) ii) is at least one of N-(3-N'-acylaminopropyl)-N, N-dimethylammonium acetate in which the acyl group contains from 8 to 18 carbon atoms, and N-alkyl-N, N-dimethylammonium acetate in which the alkyl group contains from 8 to 18 carbon atoms.

10. The concentrate of claim 1 wherein component b) iii) is at least one carboxylic acid wherein the acid may be completely or partially present in salt form and the alkyl group therein contains from 7 to 22 carbon atoms.

11. The concentrate of claim 10 wherein in the at least one carboxylic acid the alkyl group contains from 10 to 22 carbon atoms.

12. The concentrate of claim 1 which additionally comprises up to about 5% by weight of a polyalkylene glycol corresponding to the formula $H-(OC(H)R^1-CH_2)_n-OH$, in which $R^1$ is hydrogen or a methyl group and n is an integer of 4 to 40.

13. The concentrate of claim 1 which additionally comprises up to about 5% by weight of an alkyl polyglycoside corresponding to the formula $R^2O-(Z)_x$, in which $R^2$ is a linear or branched alkyl or alkenyl group containing 6 to 22 carbon atoms, Z is a sugar unit from the group of aldopentoses or aldohexoses, and x is on average a number of 1.3 to 1.8.

14. The concentrate of claim 1 which contains from about 0.2 to about 5% by weight of an inorganic carrier phase stabilizing agent selected from the group consisting of layer silicates, aluminum oxide hydrates and precipitated silicas.

15. The concentrate of claim 1 which additionally comprises from about 0.1 to about 3% by weight of a polymer selected from the group consisting of polysaccharides, modified cellulose molecules, and synthetic polycarboxylates.

16. The concentrate of claim 2 wherein component a) is an inorganic salt;

component (b) i) contains from 8 to 18 carbon atoms in the alkyl group and from 2 to 8 ethylene oxide groups; component b) is present in from about 3 to about 20% by weight; and component b) iii) is at least one carboxylic acid wherein the acid may be completely or partially present in salt form and the alkyl group therein contains from 7 to 22 carbon atoms.

* * * * *